US005350239A

United States Patent [19]

Strand et al.

[11] Patent Number: 5,350,239

[45] Date of Patent: Sep. 27, 1994

[54] SUSPENSION AND VENTING

[75] Inventors: Olaf Strand, Porsgrunn, Norway; Donald M. Martin, Louth, England

[73] Assignee: Norsk Hydro A.S., Oslo, Norway

[21] Appl. No.: 168,410

[22] Filed: Dec. 17, 1993

Related U.S. Application Data

[63] Continuation of Ser. No. 956,259, Oct. 5, 1992, abandoned.

[30] Foreign Application Priority Data

Oct. 3, 1991 [GB] United Kingdom ..... 9121002

[51] Int. Cl.[5] ..... B65D 33/01; B65D 33/14

[52] U.S. Cl. ..... 383/7; 383/101; 383/103

[58] Field of Search ..... 383/8, 24, 100, 102, 383/103, 111, 904, 7, 101

[56] References Cited

U.S. PATENT DOCUMENTS

| | | | |
|---|---|---|---|
| 3,133,691 | 5/1964 | Corbett | 383/103 |
| 3,149,772 | 9/1964 | Olsson | 383/103 |
| 3,237,844 | 3/1966 | Hughes | 383/103 X |
| 3,378,189 | 4/1968 | Dickson | 383/103 X |
| 3,937,396 | 2/1976 | Schneider | 383/103 X |
| 3,944,127 | 3/1976 | Bruke et al. | 383/100 X |
| 3,951,284 | 4/1976 | Fell et al. | 383/100 X |
| 4,312,392 | 1/1982 | Sekiguchi | 383/8 |
| 4,390,051 | 6/1983 | Cuthbertson | 383/111 |
| 4,461,402 | 7/1984 | Fell et al. | 383/103 X |
| 4,750,846 | 6/1988 | Myklebust et al. | 383/101 X |
| 4,781,472 | 11/1988 | LaFleur et al. . | |
| 4,874,258 | 10/1989 | Marino | 383/111 |

FOREIGN PATENT DOCUMENTS

| | | | |
|---|---|---|---|
| 0183573 | 6/1986 | European Pat. Off. . | |
| 0288079 | 10/1988 | European Pat. Off. . | |
| 0139383 | 5/1990 | Japan | 383/24 |

*Primary Examiner*—Allan N. Shoap
*Assistant Examiner*—Jes F. Pascua
*Attorney, Agent, or Firm*—Wenderoth, Lind & Ponack

[57] ABSTRACT

A flexible intermediate bulk container has a liner which is provided with one or more hollow suspension members for fastening the liner to an outer container in correct relative position. The suspension means members form vents for expulsion of air from the liner during and subsequent to filling with particulate bulk material. The suspension members are preferably tubular to provide vents for the interior of the liner. Such vents may be controlled by one-way valve devices.

31 Claims, 5 Drawing Sheets

SUSPENSION AND VENTING

This application is a continuation of now abandoned application, Ser. No. 07/956,259, filed Oct. 5, 1992 now abandoned.

BACKGROUND OF THE INVENTION

The present invention relates to a liner for a flexible container and to such container incorporating a liner, particularly but not exclusively for transport and storage of bulk material, especially pulverized or granular material.

Flexible containers for bulk materials, so called FIBC's, normally comprise an outer container bag with lifting loops and a filling opening.

For most users of such flexible containers it is necessary that the material to be transported is protected against being contaminated by dust, water, etc., and this is usually achieved by the use of an impervious liner made from plastic sheet material, paper or suchlike which is positioned within the outer container, usually against the inner wall thereof, the liner being filled with the material to be transported and/or stored.

It has been found desirable to position the liner in its load-carrying outer container at the production site of the container, and one way of making such a composite container is to fasten the liner to the material forming the outer container, part way through the assembly of the container, with glue or tape, thereafter finishing the sewing of the outer container.

However it has proved to be difficult to place the liner in the outer container in such a way that it is neither damaged, nor crumpled and adopts a form which matches that of the outer container. Otherwise the liner becomes prone to bursting when filled with bulk material. Furthermore, displacement and unfastening of the liner may occur during use and obviously placing the liner correctly during bag manufacture does not help if it is displaced before or during the filling operation.

one method of aligning the liner in the outer container is disclosed in European Patent 0141429 in which the container is placed inside a folding means in the form of a tunnel or open ended box having a square cross-section, the liner thereafter being placed inside the finished outer container and then inflated. The longitudinal side walls of the box are divided and joined together, for example, by hinges. Subsequent to inflation the box is pressed together and during this operation the hinged side walls form gussets in both the liner and the outer container. The container and liner are pressed together and can then be drawn out of the box and, optionally can also be folded crosswise of the longitudinal direction, and are then ready for transport to the filling site for bulk material.

Due to the open nature of the woven cloth making up the outer container, all superfluous air between the outer container and the inner liner will be squeezed out so that in the final flattened form no air is present between the liner and the outer container, thus avoiding difficulties at later filling stages and ensuring that the liner and the outer bag are in correct alignment.

This method, while providing a correct, smooth and crease-free fit between the inner liner and the outer bag, does, however, require an extra manufacturing step at the bag production site. Furthermore, the method does not solve a further problem caused by air remaining inside the inflated liner that is entrapped by the granular, particulate bulk material during filling of the bags. Such air remaining inside the liner bag after the bag is filled may constitute as much as up to 10 to 15% of the total volume of the bulk material, when the filling spout of the liner is sealed, which is desirable to obtain maximum protection. The trapped air will only leak out gradually over time and causes considerable problems in connection with the subsequent handling, transport and storage of the filled bags.

When the filled sacks are handled and stacked, the contents settle and compact, allowing the trapped air to form a deformable cushion within the sack. This can cause the sack to adopt a rounded shape, affecting the stability of a stack of the sacks and making it difficult to handle the filled sacks mechanically. Furthermore, the trapped air will expand or contract with variations in the surrounding temperature, causing the air cushion to swell and deflate. In an extreme case, this can cause the wall of the sack to rupture where excess expansion of the air cushion takes place.

SUMMARY OF THE INVENTION

It is an object of the present invention to provide a liner which may properly and efficiently be located in the outer container and to alleviate the above mentioned air entrapment problems.

Another object of the invention is to provide a container with an inner liner which alleviates excess of air and air entrapment problems during prolonged storage.

Another object of the invention is to improve the efficiency of manufacturing the lined containers.

A liner in accordance with the invention for use with a tougher outer container is made of flexible plastic material and comprises at least one suspension means for connecting the liner to the outer container in a predetermined orientation, the suspension means forming a vent for the expulsion of air from the liner.

The liner which is preformed may be folded into a substantially air-free configuration and then secured within the outer container, each suspension means of the liner being connected to an upper part of the container.

The liner is preferably designed to be of such a size relative to the container in which it is to be placed that, on connection of the suspension means to the container, the liner, on filling, conforms to the internal dimensions of the container.

Preferably each suspension means is formed as a tubular strip of the material of the liner.

When a bag with the liner has been filled, the spout inlet is closed, but air within the liner may be vented through the tubular suspension means and/or through one or more vents or vent holes in a wall of the tubular suspension means and/or in the wall of the liner. In order to prevent ingress of moisture, a one-way valve means is preferably provided to control flow of air/water through the vents and/or vent holes.

The one-way valve means may be provided by the action of opposite walls of the liner which seal against each other, this one-way valve being especially efficient when the vents are provided in a tubular suspension means.

Additionally, and particularly if the vent holes are formed near an upper corner of the container, the flow of air through the vent holes may be controlled by a one-way valve comprising a "labyrinth" seal.

In an alternative form of the invention, a liner for a flexible container has an inlet at one end thereof, one or more vents located at or adjacent the inlet end with at least two elongated seals being provided between opposed walls of the liner adjacent the or each vent on the body side of the vent, the elongated seals overlapping axially with one another to provide a labyrinth path between the interior of the liner and the vents.

BRIEF DESCRIPTION OF THE DRAWINGS

The invention will now be described by way of example with reference to the accompanying drawings, in which.

DETAILED DESCRIPTION OF THE INVENTION

Figure 1:
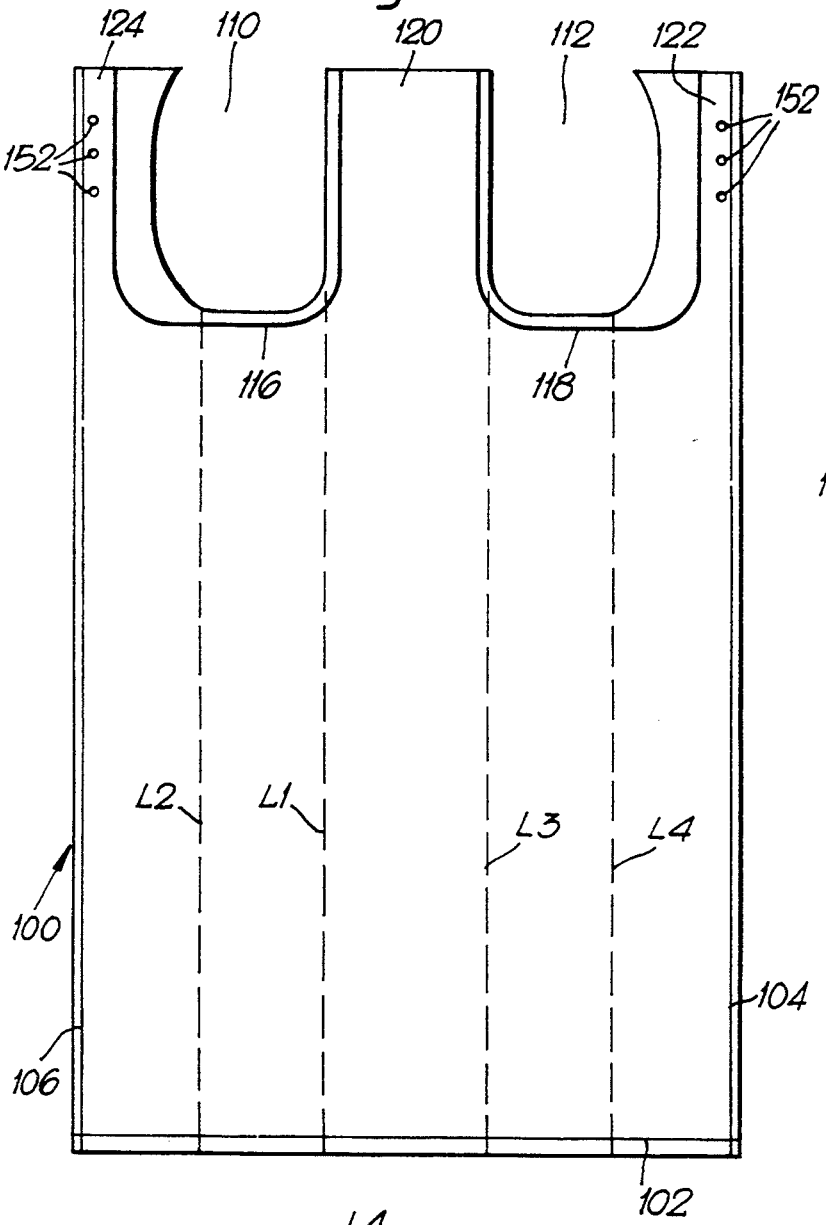
FIG. 1 is an elevation view schematically showing one embodiment of a liner in accordance with the invention.
Figure 3:
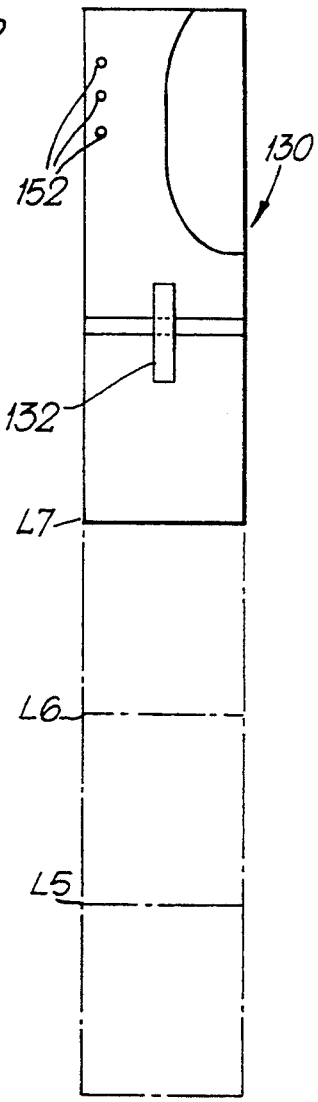
FIG. 3 is a view of the liner shown in FIG. 2 after longitudinal folding.
Figure 2:
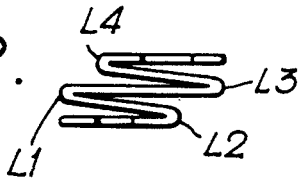
FIG. 2 is an end view, after transverse folding, of the liner of FIG. 1.

Referring to FIGS. 1–3, a liner 100 is formed from two sheets of impervious, flexible material, preferably plastics, which are joined together by an end welded seam 102 and side welded seams 104, 106 to form a bag which is open at one end and which has regions 110, 112 removed therefrom at that end to form a castellated end shape. Further seams or welds 116, 118 are then formed at the periphery of each region 110, 112 to define three essentially tubular members 120, 122 and 124. The tubular member 120 provides a filling spout for the liner bag while tubular sections 122 and 124, form suspension means for connecting the liner to an outer container. The suspension tubes 122, 124 further provide an "air release" function as will be described hereinafter.

After manufacture the liner bag 100 is folded to form a compact package 130 (See FIG. 3) from which most air has been expelled. To accomplish this, the liner 100 is folded on longitudinal folding lines L1, L2, L3 and L4 illustrated by dotted lines in FIG. 1 to form a compact shape as shown in plan in. FIG. 2. The liner is then folded out of the plane of the paper along folding lines L5, L6 and L7 (See FIG. 3) in sequence to arrive at the completely folded package 130 as shown in the top part of FIG. 3. An adhesive tape 132 is used to hold the liner in a folded position.

Figure 4:
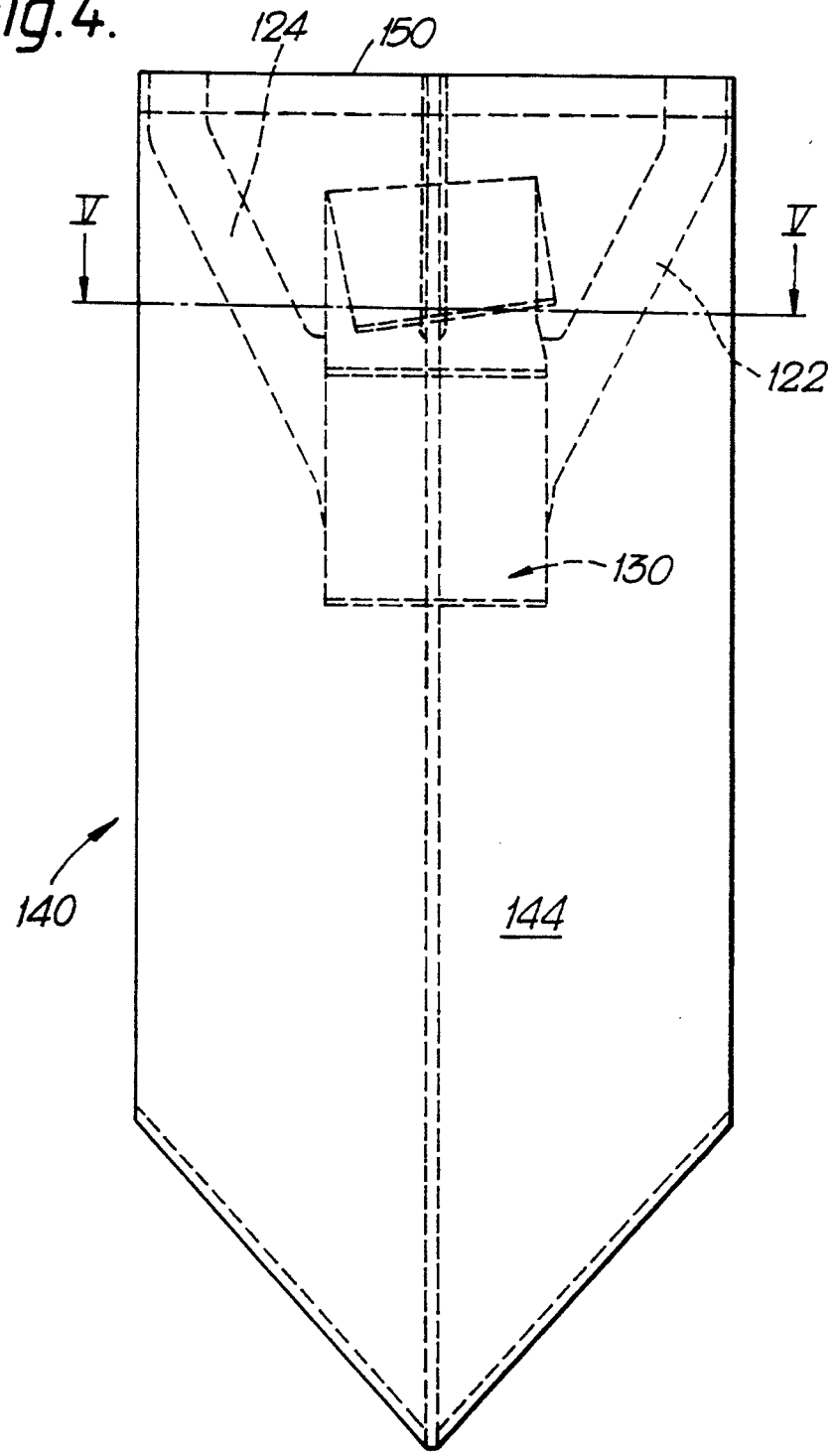
FIG. 4 is a view of a composite container (FIBC) with an inner bag or liner similar to that shown in FIGS. 1–3 mounted in position and ready for filling.
Figure 5:
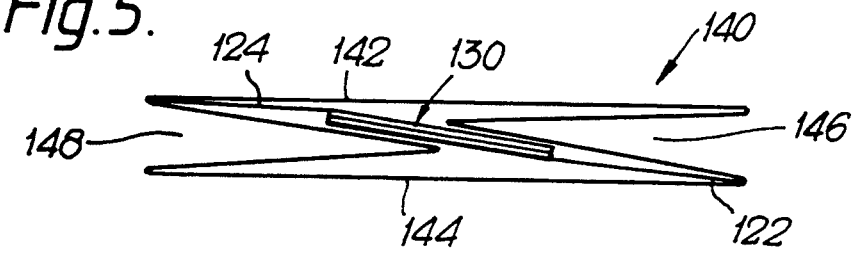
FIG. 5 is a sectional view taken on Line V—V of FIG. 4.

The folded liner is then attached within and orientated relative to, an outer container bag 140 as is illustrated schematically in FIGS. 4 and 5.

The outer container 140 which is for example made from woven polypropylene, is shown in a "ready for use" condition having front and rear sides 142, 144 and two internal folds or gussets 146, 148. The outer container is provided with an integral lifting strap formed in a top section by folding and sewing in the conventional manner. The lifting strap may be of a single point or multiple point construction. Also, the bottom of the outer container may be of the form as shown which unfolds to form a rectangular bottom or may be a star or double square bottom.

The folded liner 130 is stowed between sides 142, 144 and between the gussets 146, 148. The liner is attached to the outer container by means of the suspension tubes 122, 124 which are provided with fastening means (not shown) and are disposed in line and flush with the upper edge 150 of the container 140 and connected to diagonally opposite corners of the sides 142, 144 as shown in FIG. 4.

In use, when it is desired to fill the container, filling apparatus having a filling tube (not shown) is inserted in the filling spout 120 of the liner, the liner bag 100 is inflated against the outer bag 140 and the liner unfolds and expands against the outer bag without creasing. The liner only then being filled with bulk or granular material.

Alternatively, the bulk material may be filled directly into the compacted liner 130, which expands during filling. The only air which is allowed to enter the liner is then the air remaining in the bulk material itself.

After filling the spout 120 is closed or sealed.

The tubular suspension means 122, 124 provide a further function of one-way valve means allowing air remaining in the bulk material to escape. The one-way valve action is provided by the portions of the sheets of flexible material forming the sides of each tube which generally lie in contact one with the other but which part in response to positive pressure within the liner to allow air to be expelled. This expulsion of air may be assisted by vent holes or openings 152 provided in the sides of the tubular sections. When the air has exited from the liner, the sides of the suspension tubes 122, 124 seal together to close the tubes and the openings 152 to prevent entry of air or water.

The material of the liner may be made of mono extruded polyethylene, 80/100 microns thick. Alternatively, it is envisaged that the liners can be made of a thicker multi-layer polypropylene material, say, from 80–85 microns, the different layers having different properties, e.g. the outer layers being strong but permeable and the inner layer being impermeable and having good welding characteristics. It is desirable for the liner material to have properties of strength, puncture resistance and permeability but this is not easily obtainable in a single layer construction. Alternatively, laminated container materials may be employed.

The embodiments of the invention described are not to be construed as limitative. For example, instead of two suspension means 122, 124, a single suspension tube or three or more suspension tubes may be used. Furthermore the form and size of the filling spout or spouts may be changed according to requirements as may be the size and placement of the openings. 152. Alternatively, the openings 152 may be removed completely.

Furthermore, although the liner has been shown formed from two pieces of material, the liner may equally be formed from a piece of tubular material in which case the side seams 104, 106 are unnecessary.

The liner can also be an integral part of the container, whereby the alternative venting with the special labyrinth vents is used according to the invention. Especially when venting containers of small size, these may initially be made from impervious materials, so that only the venting problems remain to be solved.

Advantages which are provided by a liner bag of the present invention are:

1. The liner will have a correct position in relation to the outer bag when the liner is inflated.
2. The liner will retain its correct position in relation to the outer bag during transport and handling of the empty bags as well as during filling and emptying of the bag. Neither will the liner be displaced if water accidentally penetrates into the bag.
3. An additional blow-folding step during production is eliminated resulting in saving of a manufacturing operation.
4. There is substantially no air within the empty liner, which might otherwise have caused problems during baling/paletting of the empty bags for transport to packaging sites, i.e. there is no risk of bursting of the liners when the bales or palettes are compressed. The paletted units are also more stable (not subject to displacement).
5. Due to the presence of exhaust valves incorporated in the liner, superfluous air in the bag after filling is able to be evacuated so that the formation of an "air balloon" above the bulk material after the bag has been filled and the liner has been closed or sealed is prevented. This avoids the risk of the liner bursting when the bags are stacked on top of each other in a number of layers.

Figure 6:
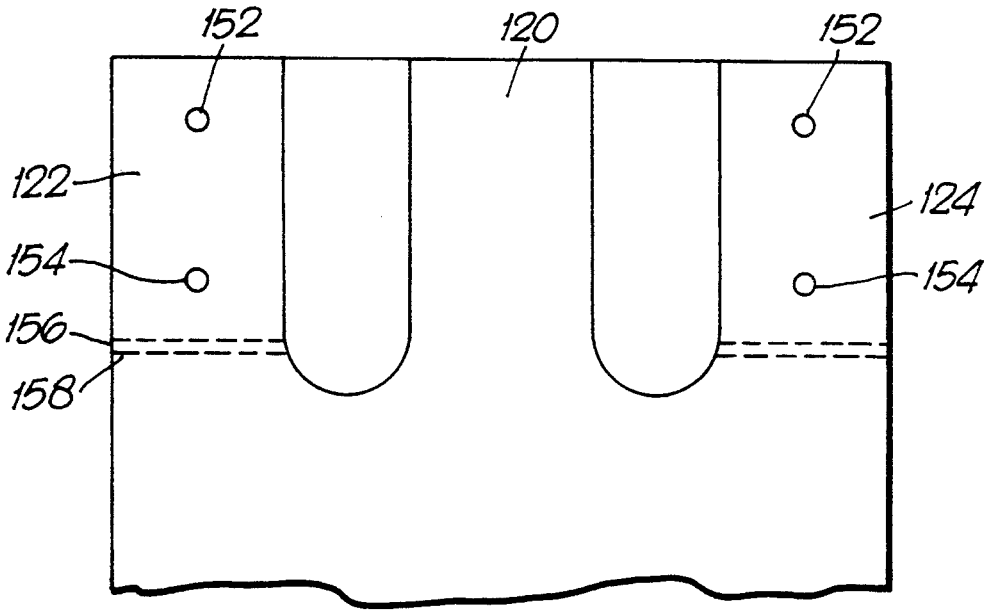
FIG. 6 is a diagram showing a liner similar to that shown in FIGS. 1–3 but having a labyrinth seal providing a one-way valve controlling vent holes in a suspension means.
Figure 7:
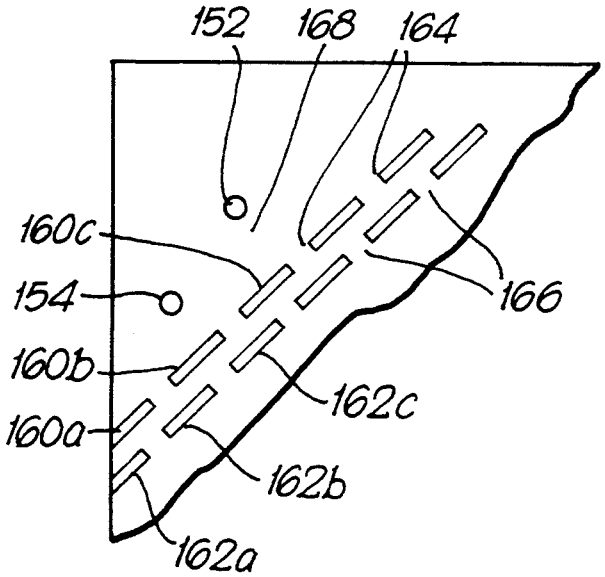
FIGS. 7–10 are diagrams showing alternative versions of a labyrinth seal to control vent holes provided in the liner.

In the alternative shown in FIG. 6, the vent/seal combination is formed in the side pieces 122 and 124 by punching two vent holes 152 and 154, typically about 5 mm diameter in the upper and lower portions of the side pieces approximately as shown, and forming two interrupted linear seals 156 and 158 across the foot of each side piece as shown. The gaps in the line seals and the spacing between the linear seals are shown in detail in FIG. 7, which relates to a bag with an integral liner.

The vent holes 152 may be provided by forming one or more apertures in the wall of the container as illustrated, for example by cutting a slit in the wall or punching a circular or other shaped hole in the wall material. If desired, the wall material can be only partially cut away to form a flap which overlies the aperture and assists in preventing ingress of water or moisture into the sack. Typically, the aperture has a plan area of less than 3 to 15 square mms and has a maximum dimension of less than 10 mms. Conveniently, approximately 5–7.5 mms diameter circular vent holes are used. Preferably, one of the vent holes is formed axially lower in the liner wall so that water which might enter the dead space through the upper hole can drain out through the lower hole rather than penetrating the seal to enter the body of the sack.

A labyrinth seal may be used to valve the vents, each seal being formed as linear heat seals between opposed walls or seals of the container, for example by applying a heat sealer bar to the sack during its manufacture or by applying adhesive between the appropriate areas of opposed walls of the sack. The seals may be simple straight line seals or may be of more complex shapes. Thus, the seals can be curved or can be of dogleg or waveform shape. For simplicity, the invention will be described hereinafter in terms of a simple straight line seal.

The labyrinth is formed by overlapping at least two of the line seals for part of their length, e.g. for from 10 to 50% of their length. If desired, more than two seals can be used so that there is multiple overlap to give a more tortuous path between the interior of the sack and the vent. Alternatively, one line seal can be interrupted to form two or more axially aligned portions each separated by an axial gap; and a second seal or line of seals formed which overlaps the gap(s). Preferably the line of seals extends to the outer edge of the container. The path between the seals typically has a maximum cross-sectional area of less than 0.5 to 5 square mms. Preferably, the seals are spaced less than 20 mm, for example from 5 to 10 mms apart so that particles of the granular material cannot readily escape from the sack via the seals and so that the path will tend to self seal when the bag is flexed during handling and there is a tendency to draw air into the sack through the vent. Where an interrupted line seal is used to provide axial gaps in a line seal, the gaps typically extend for from 10 to 50% of the adjacent sealed portion of the line. Thus a gap can be from 10 to 15 mms long with the sealed portions each being from 25 to 50 mms long.

The line seals 156, 158 shown are interrupted to form two parallel series of short seals 160*a*, 160*b*, 160*c* etc. and 162*a*, 162*b*, 162*c* etc with axial gaps 164 and 166 between the short seals. The short seals of line seals 156, 158 overlap each other by approximately 20 to 30% at each end and the gaps 164 and 166 between the short seals are typically 10 to 15 mms and the line seals are spaced 10 to 30 mms apart. This forms a dead space 168 outside the seals, and two circular vent holes 152 and 154 as punched through the liner wall in this dead space.

Figure 8:
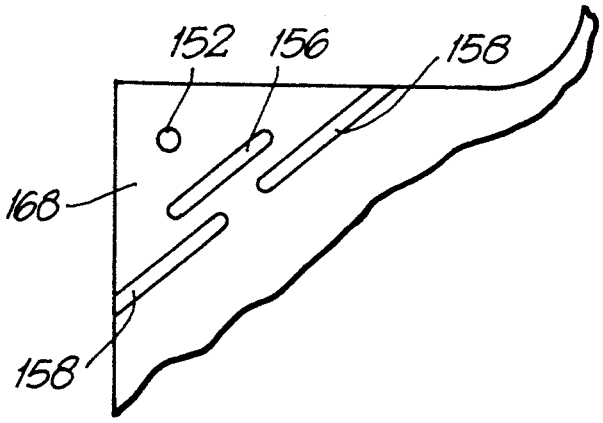
Figure 11:
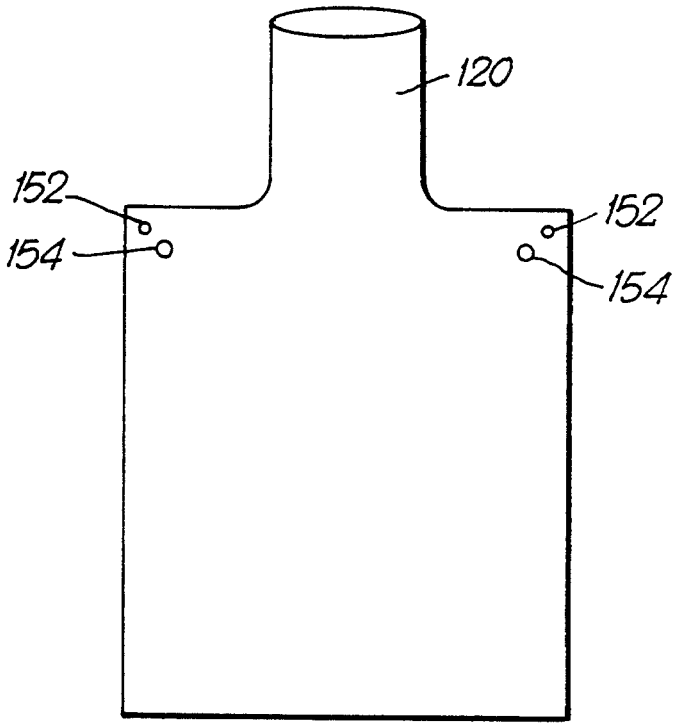
FIG. 11 is a diagram illustrating a liner or bag provided with a filling spout and with air vents controlled by a labyrinth seal.

The labyrinth seals may be arranged as shown in FIG. 8, especially if the vents are located in the upper corners of a liner or bag in a construction having only a central filling spout as shown in diagrammatic form in FIG. 11. Alternatively the seals may be employed with a liner bag having vented or tubular suspension means.

Figure 9:
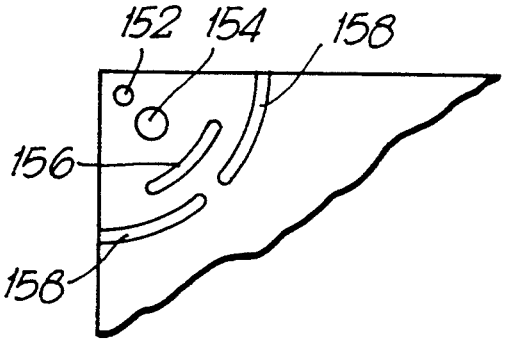
Figure 10:
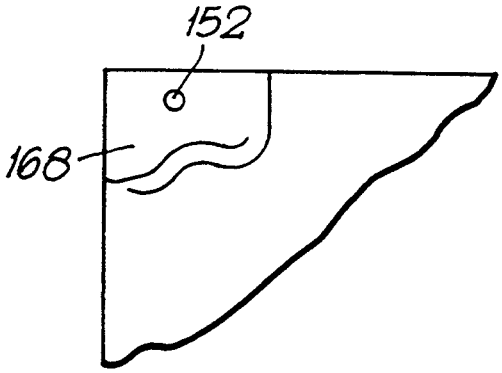

Alternatively, the seal can be provided by curved line seals as shown in FIG. 9 or wave or saw tooth form seals as shown in FIG. 10. In the latter case the seals can be in or out of phase so as to enable a fine path to be formed without the need for extreme accuracy in placing the seals.

When the liner is to be manufactured in different sizes it has been found that the U-shaped cut-outs 110,112 between the central filling spout 120 and the suspension means 122,124 may be maintained constant. This enables a welding tool having single sized U-shaped inner parts 170 (See FIG. 12) to be employed.

When the outer edge 172 of the suspension means 122,124 is substantially aligned with the corresponding side seams 174 of the liner bag then there is no need for there to be a separate weld along the outer edge of the suspension means since this is already sealed during the formation of the bag.

If, however, the bag width is wider so that the side edge 174 of the liner bag is a significant distance away from the side edge 172 of the suspension means 122, 124 (which means are fairly narrow so as to function properly as a vent, e.g. from 40–80 mm), then it is necessary to weld the material of the bag along the curved lines 176.

Figure 12:
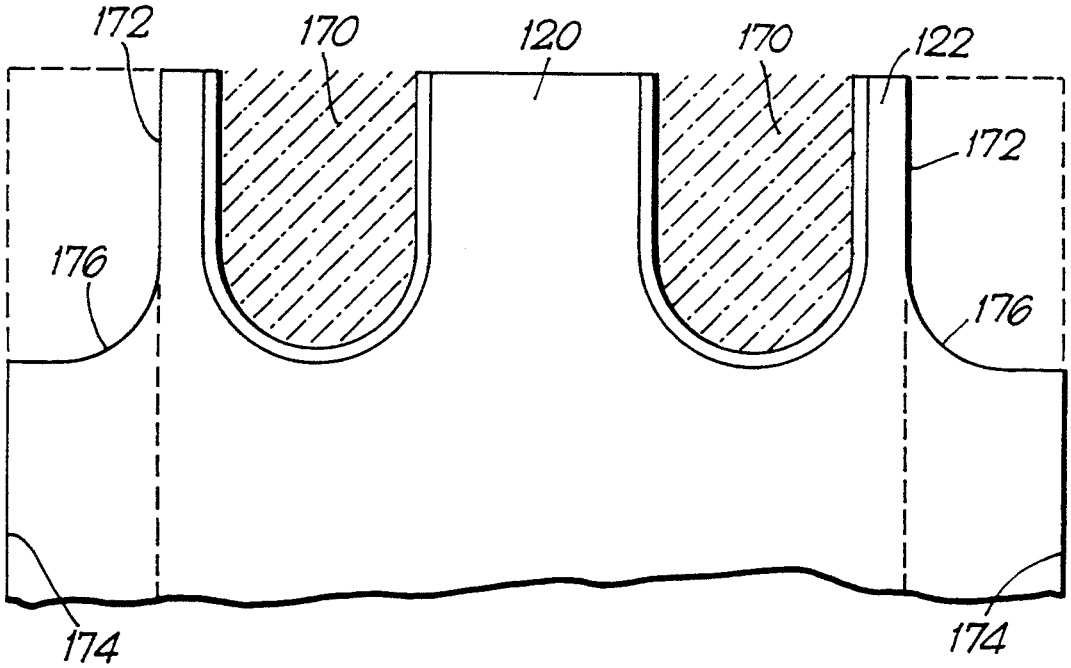
FIG. 12 is a diagramatic view of the top end of a liner similar to that illustrated in FIGS. 1–3 to illustrate the use of an appropriate welding tool.

To this end the part of the welding tool illustrated in FIG. 12 is used to form the inner edge and the curved line 176 may be used only when desired. When it is not desired, this part is left cold but is heated when welding is desired. Thus liner bags having a width of between 1270 and 2030 mm can be produced using the same tool.

We claim:

1. In a flexible intermediate bulk container including a flexible outer bag, said bag having a top, a bottom and side walls, and a flexible inner liner located within said bag and to have filled therein granular material, said liner having a top, a bottom and side walls extending downwardly from said top, the improvement comprising:

said liner including at said top thereof at least one suspension member connecting said top of said liner to said top of said bag such that said liner, when granular material is filled therein, will be positioned in a predetermined orientation within said bag;

said side walls of said liner being entirely free of direct connection to said side walls of said outer bag, such that said liner is connected to said outer bag solely by said at least one suspension member; and said liner having extending therethrough, adjacent said top thereof, a vent connecting an interior of said liner to a space exterior thereof, to thereby enable expulsion of air from said interior of said liner.

2. The improvement claimed in claim 1 wherein said suspension member comprises an integral extension of material forming said liner.

3. The improvement claimed in claim 1, wherein said vent extends through said suspension member.

4. The improvement claimed in claim 3, wherein said suspension member comprises a tubular suspension member having a hollow tubular configuration.

5. The improvement claimed in claim 4, wherein said vent comprises a hollow interior of said tubular suspension member.

6. The improvement claimed in claim 5, wherein said tubular suspension member has through a lateral wall thereof at least one vent hole.

7. The improvement claimed in claim 6, wherein said wall is internally abuttable by an opposite wall of said tubular suspension member, thereby closing said vent hole and defining a one-way valve preventing ingress from said exterior space to said interior of said liner.

8. The improvement claimed in claim 7, further comprising at least two seals formed between said walls adjacent said vent hole to define a labyrinth path between said interior of said line and said vent hole.

9. The improvement claimed in claim 8, wherein said seals are interrupted by gaps, and said gaps are staggered.

10. The improvement claimed in claim 5, wherein opposite walls of said tubular suspension member are abuttable to thereby close said interior of said suspension member, thus defining a one-way valve preventing ingress from said exterior space to said interior of said liner.

11. The improvement claimed in claim 1, wherein said suspension member extends upwardly from an upper end of said top of said liner.

12. The improvement claimed in claim 1, wherein said liner is of a size and shape and said suspension member is connected to said bag in an orientation such that said liner, upon filling thereof, conforms to internal dimensions of said bag.

13. The improvement claimed in claim 1, wherein said liner includes two said suspension members extending upwardly from opposite sides of an upper end of said top of said liner.

14. The improvement claimed in claim 13, wherein said liner further includes a hollow tubular filling spout extending upwardly from said top of said liner at a position between said two suspension members.

15. The improvement claimed in claim 14, wherein each said suspension member has extending therethrough a respective said vent.

16. The improvement claimed in claim 15, wherein each said suspension member has a hollow tubular configuration.

17. In a liner to be located within a flexible outer bag of a flexible intermediate bulk container and to have filled therein granular material, said liner including a top, a bottom and side walls extending downwardly from said top, the improvement comprising:

said liner including at said top thereof at least one suspension member to connect said liner to a top of the bag such that said liner, when granular material is filled therein, will be positioned in a predetermined orientation within the bag;

said side walls of said liner being entirely free of connecting structure to be connected directly to side walls of the outer bag, such that said at least one suspension member comprises the sole structure of said liner to be connected directly to said outer bag; and said liner having extending therethrough, adjacent said top thereof, a vent connecting an interior of said liner to a space exterior thereof, to thereby enable expulsion of air from said interior of said liner.

18. The improvement claimed in claim 17, wherein said suspension member comprises an integral extension of material forming said liner.

19. The improvement claimed in claim 17, wherein said, vent extends through said suspension member.

20. The improvement claimed in claim 19, wherein said suspension member comprises a tubular suspension member having a hollow tubular configuration.

21. The improvement claimed in claim 20, wherein said vent comprises a hollow interior of said tubular suspension member.

22. The improvement claimed in claim 21, wherein said tubular suspension member has through a lateral wall thereof at least one vent hole.

23. The improvement claimed in claim 22, wherein said wall is internally abuttable by an opposite lateral wall of said tubular suspension member, thereby closing said vent hole and defining a one-way valve preventing ingress from said exterior space to, said interior of said liner.

24. The improvement claimed in claim 23, further comprising at least two seals formed between said lateral and opposite walls adjacent said vent hole to define a labyrinth path between said interior of said line and said vent hole.

25. The improvement claimed in claim 24, wherein said seals are interrupted by gaps, and said gaps are staggered.

26. The improvement claimed in claim 4, wherein opposite walls of said tubular suspension member are abuttable to thereby close said interior of said suspension member, thus defining a one-way valve preventing ingress from said exterior space to said interior of said liner.

27. The improvement claimed in claim 17, wherein said suspension member extends upwardly from an upper end of said liner.

28. The improvement claimed in claim 17, wherein said liner includes two said suspension members extending upwardly from opposite sides of an upper end of said top of said liner.

29. The improvement claimed in claim 28, wherein said liner further includes a hollow tubular filling spout extending upwardly from said top of said liner at a position between said two suspension members.

30. The improvement claimed in claim 29, wherein each said suspension member has extending therethrough a respective said vent.

31. The improvement claimed in claim 30, wherein each said suspension member has a hollow tubular configuration.

* * * * *